US012144414B1

(12) United States Patent
Baker et al.

(10) Patent No.: US 12,144,414 B1
(45) Date of Patent: Nov. 19, 2024

(54) CONTAINER SLEEVE

(71) Applicants: Scott Baker, Pittsford, NY (US); Vincent Kott, Shelburne, VT (US)

(72) Inventors: Scott Baker, Pittsford, NY (US); Vincent Kott, Shelburne, VT (US)

( * ) Notice: Subject to any disclaimer, the term of this patent is extended or adjusted under 35 U.S.C. 154(b) by 0 days.

(21) Appl. No.: 18/641,756

(22) Filed: Apr. 22, 2024

Related U.S. Application Data

(60) Provisional application No. 63/461,668, filed on Apr. 25, 2023.

(51) Int. Cl.
*A45F 5/00* (2006.01)
*A47G 19/02* (2006.01)

(52) U.S. Cl.
CPC ..... *A45F 5/00* (2013.01); *A47G 19/02* (2013.01); *A45F 2005/002* (2013.01); *A45F 2005/006* (2013.01); *A45F 2200/0583* (2013.01)

(58) Field of Classification Search
CPC ..... A45F 5/00
See application file for complete search history.

(56) References Cited

U.S. PATENT DOCUMENTS 5,313,807 A * 5/1994 Owen ..... B65D 81/3886 62/530
5,842,571 A * 12/1998 Rausch ..... A45C 13/02 206/541
6,073,796 A * 6/2000 Mogil ..... B65D 81/3886 220/592.24
6,237,776 B1 * 5/2001 Mogil ..... A45F 3/02 150/112
6,385,992 B1 * 5/2002 Flore, Jr. ..... A45F 3/18 62/457.4
6,439,389 B1 * 8/2002 Mogil ..... B65D 81/3897 206/217
10,123,642 B2 * 11/2018 Gazibara ..... A47G 23/0241
11,753,209 B1 * 9/2023 Parry ..... B65D 23/14 215/395
11,759,038 B1 * 9/2023 Huebner ..... A45F 5/00 220/737
2006/0219745 A1 * 10/2006 Riley ..... A47G 23/0225 224/400
2007/0170189 A1 * 7/2007 Carlile ..... A45F 5/02 220/739
2015/0265083 A1 * 9/2015 Myers ..... A45F 5/10 220/737
2016/0081505 A1 * 3/2016 Berg ..... A45F 5/00 224/401
2016/0227949 A1 * 8/2016 Klugh ..... A45C 13/28
2018/0271310 A1 * 9/2018 Klugh ..... A47G 23/0225
2020/0085177 A1 * 3/2020 Walk ..... A45C 3/001
2020/0237082 A1 * 7/2020 Willows ..... A45F 5/00
2020/0305582 A1 * 10/2020 Willows ..... A45F 3/16
2021/0130040 A1 * 5/2021 Sanders ..... D04B 21/20
2021/0137248 A1 * 5/2021 Dow ..... A47G 23/02
2021/0229865 A1 * 7/2021 Wang ..... B65D 23/0871

* cited by examiner

*Primary Examiner* — Brian D Nash

(57) ABSTRACT

A sleeve for a container, such as a water bottle, that is configured in a manner that secures the container or that may be positioned on its side where it functions as a container itself, such as a bowl.

8 Claims, 10 Drawing Sheets

CONTAINER SLEEVE

BACKGROUND INFORMATION

Field of the Invention

The invention relates to sleeves and covers for containers such as liquid dispensing containers.

Discussion of Prior Art

Liquid dispensing containers, such as water bottles, come in a wide variety. While many are cylindrical in shape, the manner in which the bottles are constructed, from the way the bottles open and close, are carried, and are generally utilized may vary greatly. Additionally, the materials from which bottles are made varies as well, with some containers being made from, for example, basic plastics while others have, for example, a double-wall stainless steel design.

These types of containers are also used in a wide variety of situations, from being used by adults working desk jobs to kids at school, to athletes, travelers, and outdoor enthusiasts, to name just a few.

Most such containers are made from a rigid material, whether this is comprised of aforementioned plastics, steel, or other similarly suitable materials. While these materials work well for containing the liquid and being durable, they also have disadvantages. For example, they may be damaged easily if dropped, they may be slippery when placed on smooth surfaces, and they can be uncomfortable if they bounce off of a user, for example, if one were to clip such a water bottle to a bag or backpack while walking or hiking.

Container sleeves and/or covers, often made of a form of silicone or other similar materials, have been designed to mitigate many of these issues. However, the sleeves themselves have limited utility, often simply serving as an exterior barrier and lacking any other utilities or functions.

For example, it is common for pet owners, such as dog owners, to carry water bottles while walking or hiking with their dogs. Over long distances or on hot days, dogs may also need water. Additionally, most dog walkers also carry bags to collect waste along the walk or hike.

What is needed, therefore, is a sleeve for a liquid dispensing container that incorporates additional utility forms and features.

BRIEF SUMMARY OF THE INVENTION

The invention of a sleeve that fits over a water bottle and doubles as a drinking bowl for dogs. The sleeve features a strap and slit at the bottom to hold doggy bags. More specifically, the sleeve may be removed from the container, a built-in stand popped out, and used as a dog-drinking bowl. In general, it is exceptional for taking pets hiking and out on other outdoor activities.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

Figure 1:
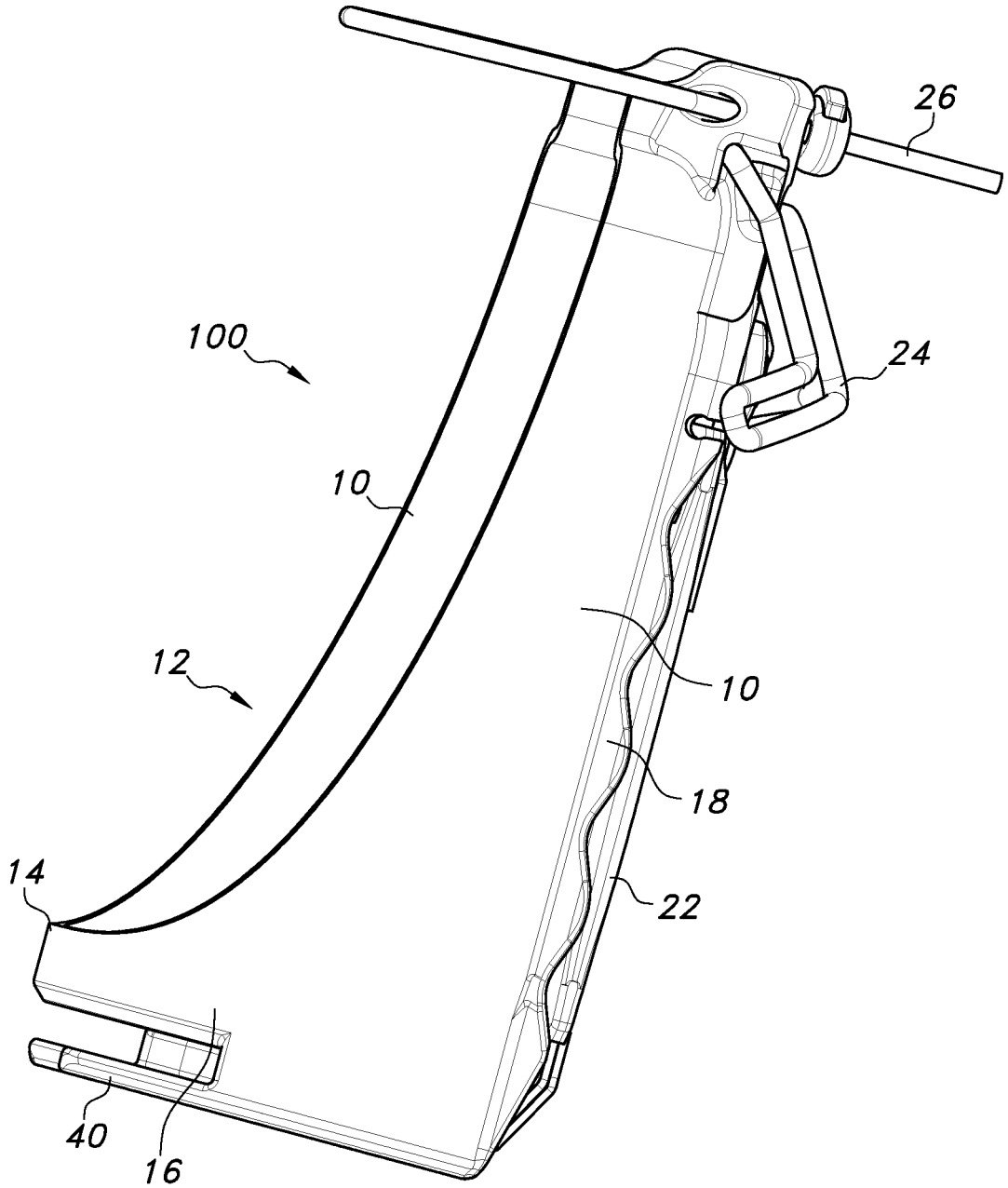
FIG. 1 is a perspective view of the sleeve according to the invention showing the side, front, and top.
Figure 2:
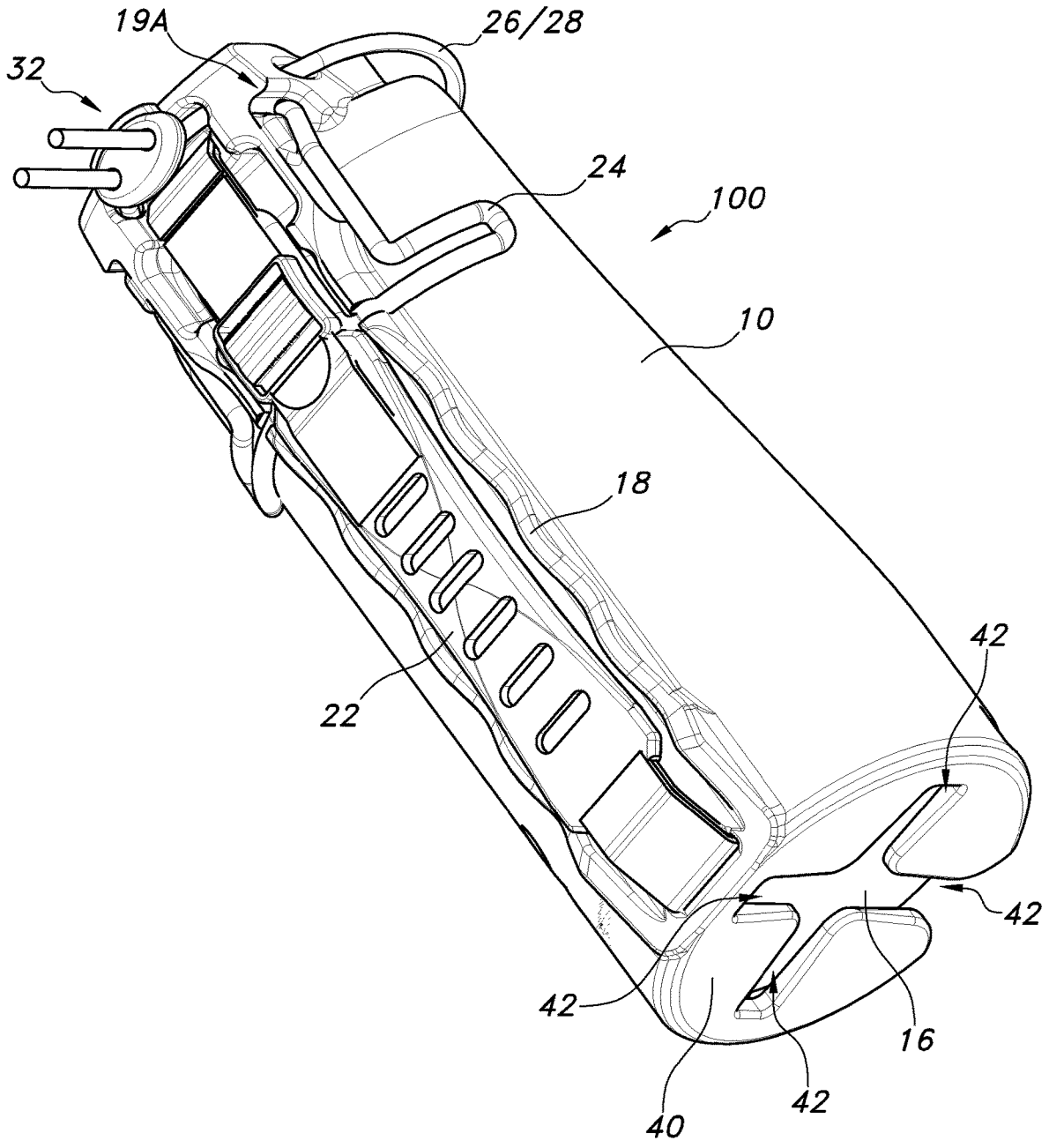
FIG. 2 is a perspective view of the sleeve showing the back, side, and bottom.
Figure 3:
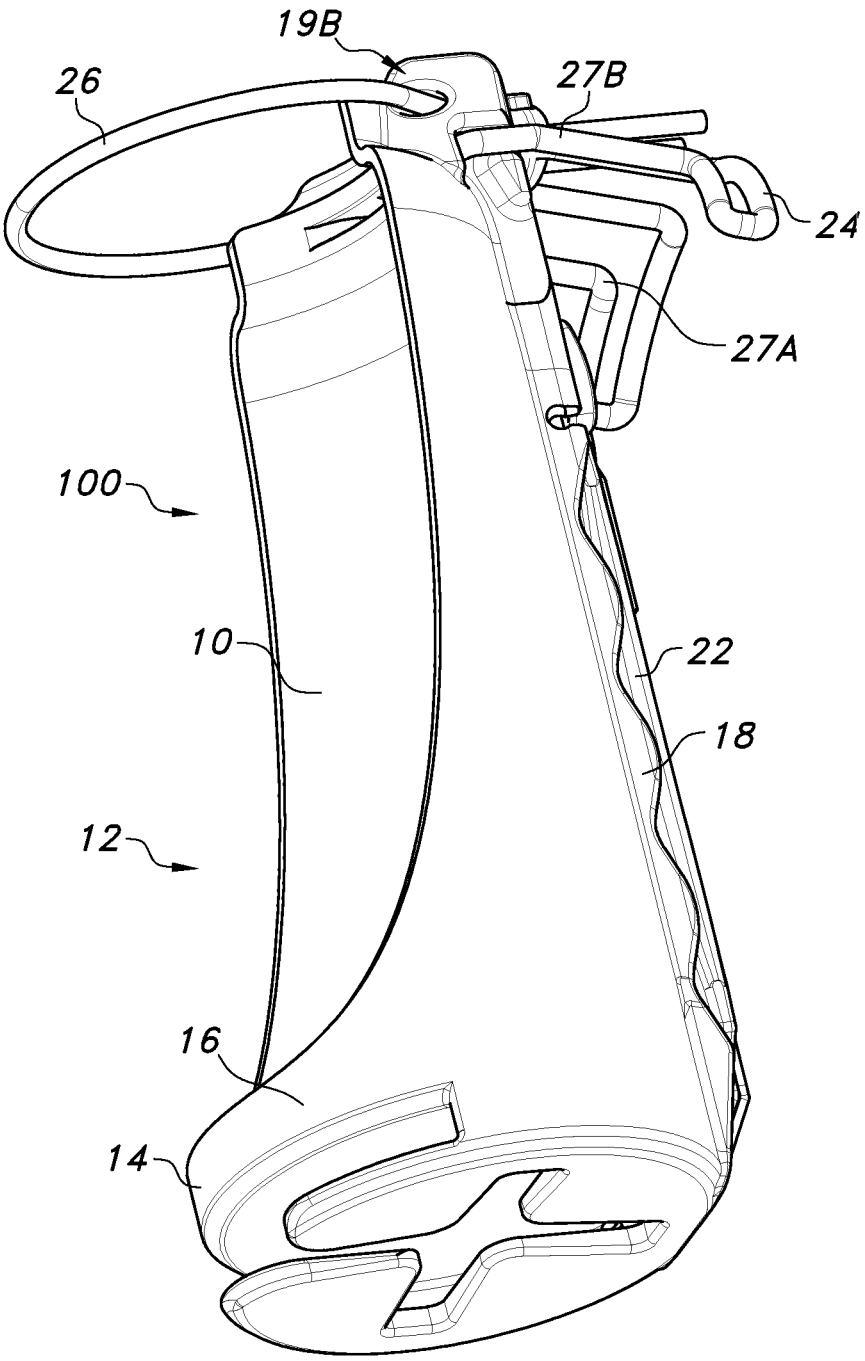
FIG. 3 is a perspective view of the sleeve showing the front, side, and bottom.
Figure 4:
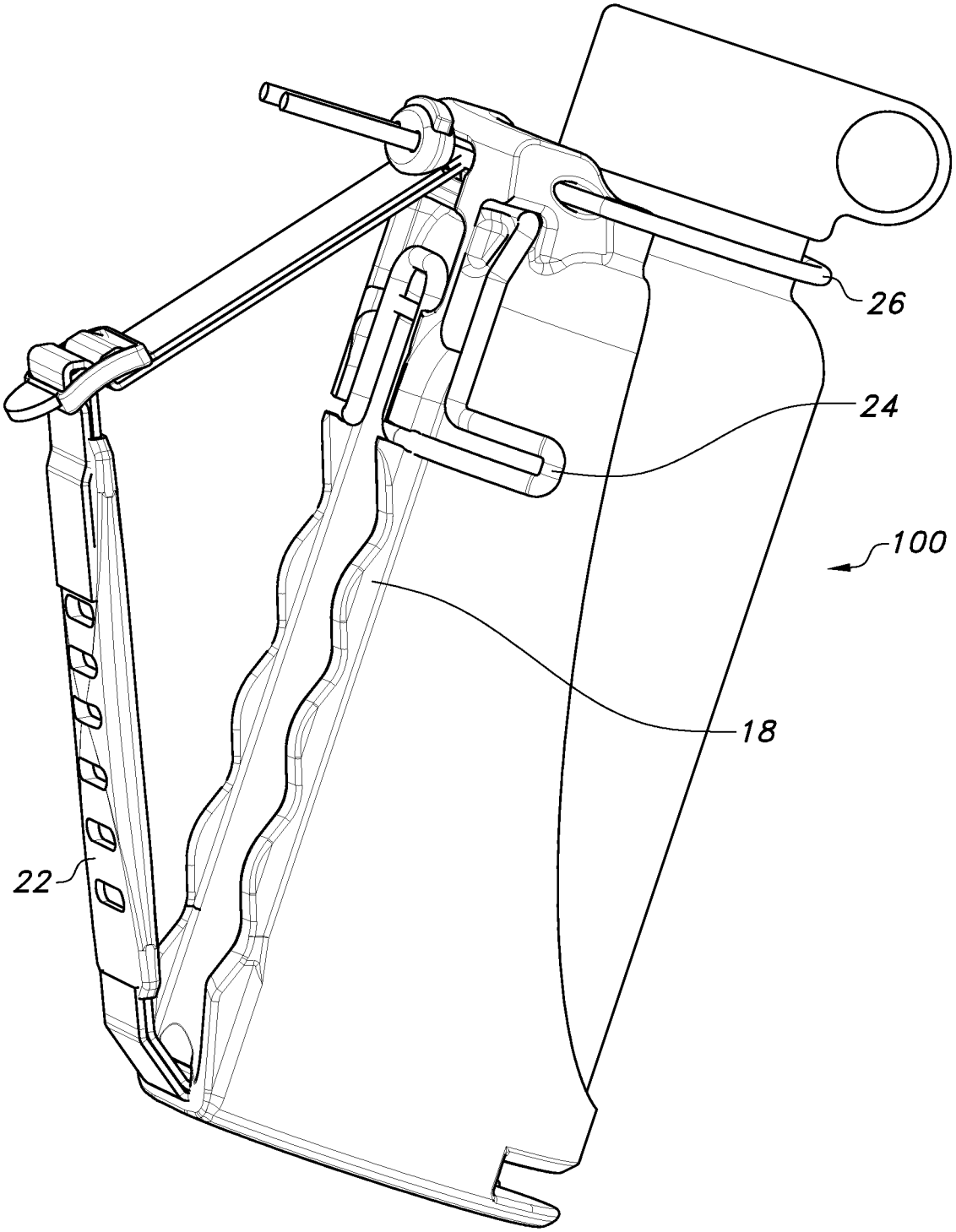
FIG. 4 is a perspective view of the sleeve showing the side and back of the device with a strap pulled out and away from the device and the device on a container.
Figure 5:
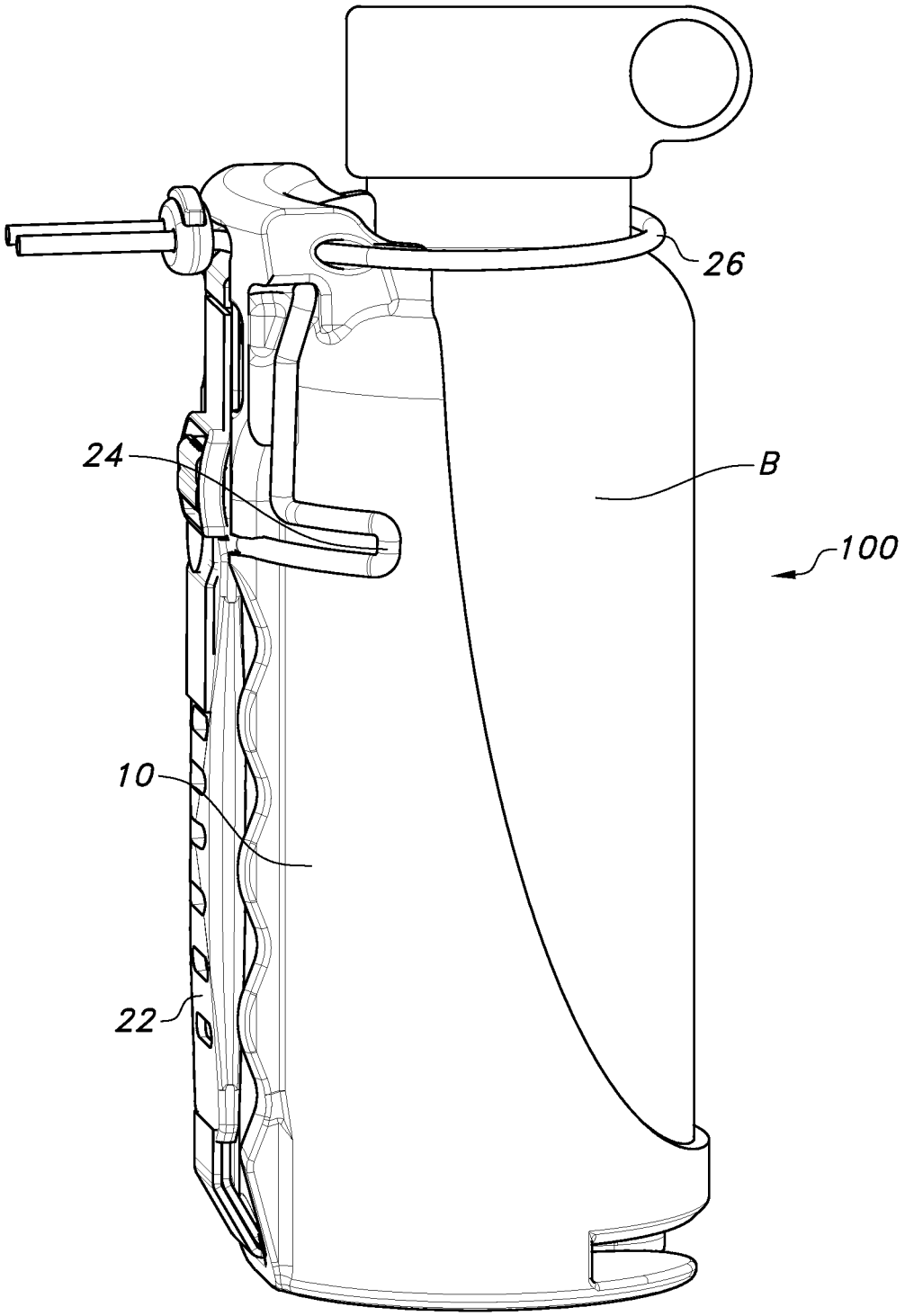
FIG. 5 is a side view of the sleeve on a container.
Figure 6:
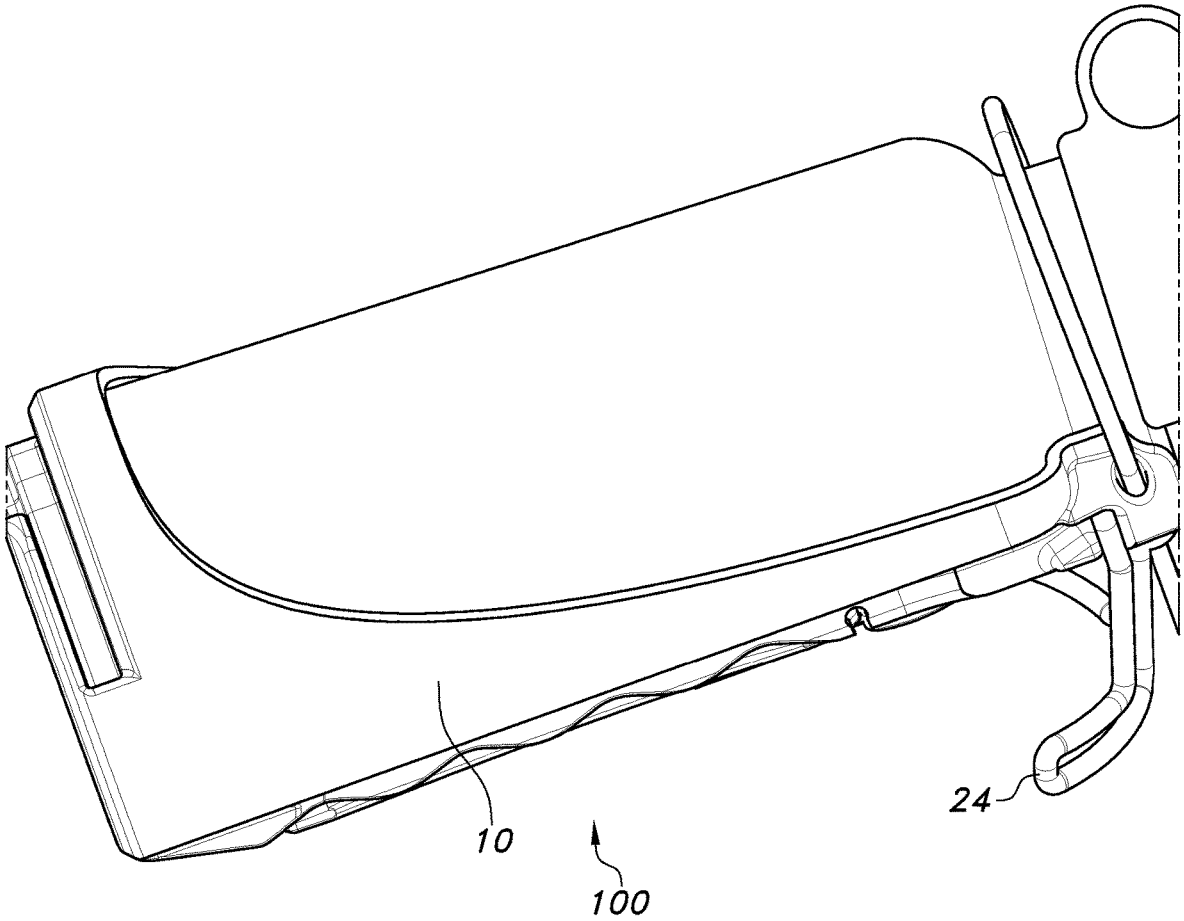
FIG. 6 is a perspective view of the sleeve holding a bottle with the support stand deployed.
Figure 7:
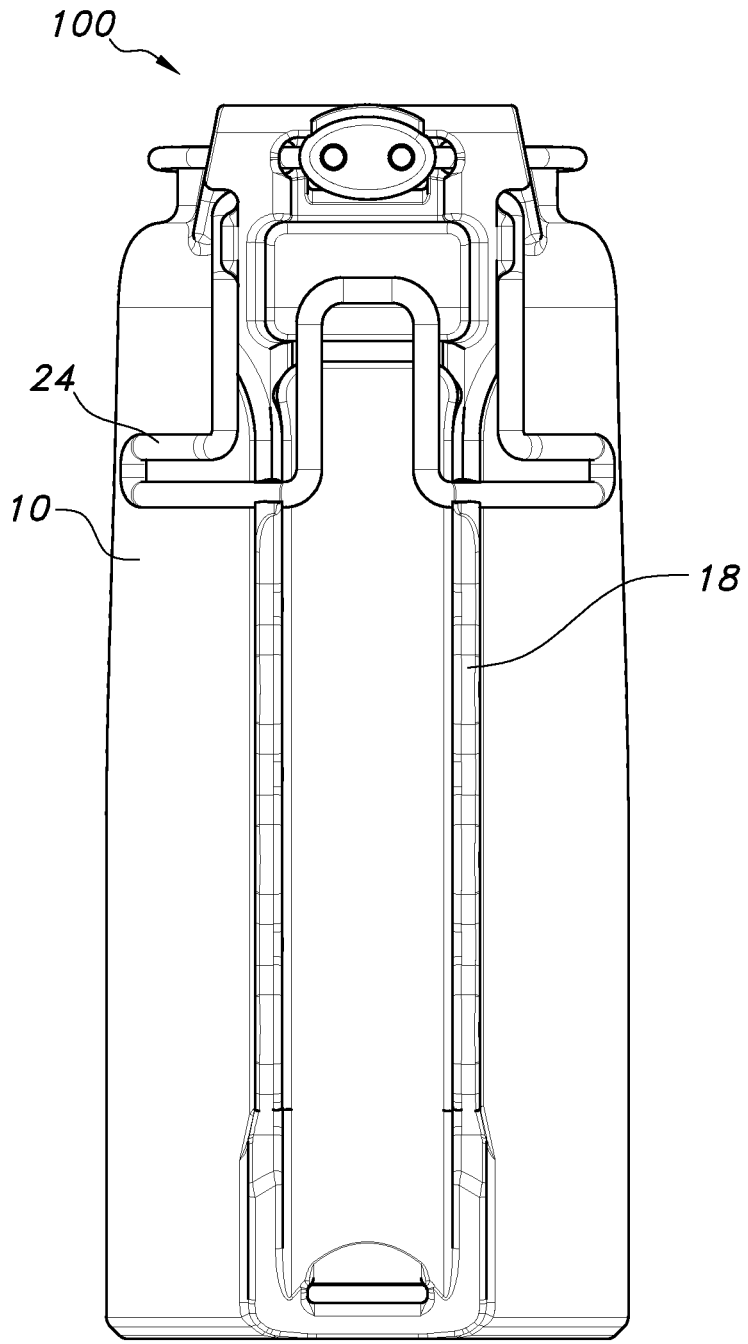
FIG. 7 is a back view of the sleeve.
Figure 8:
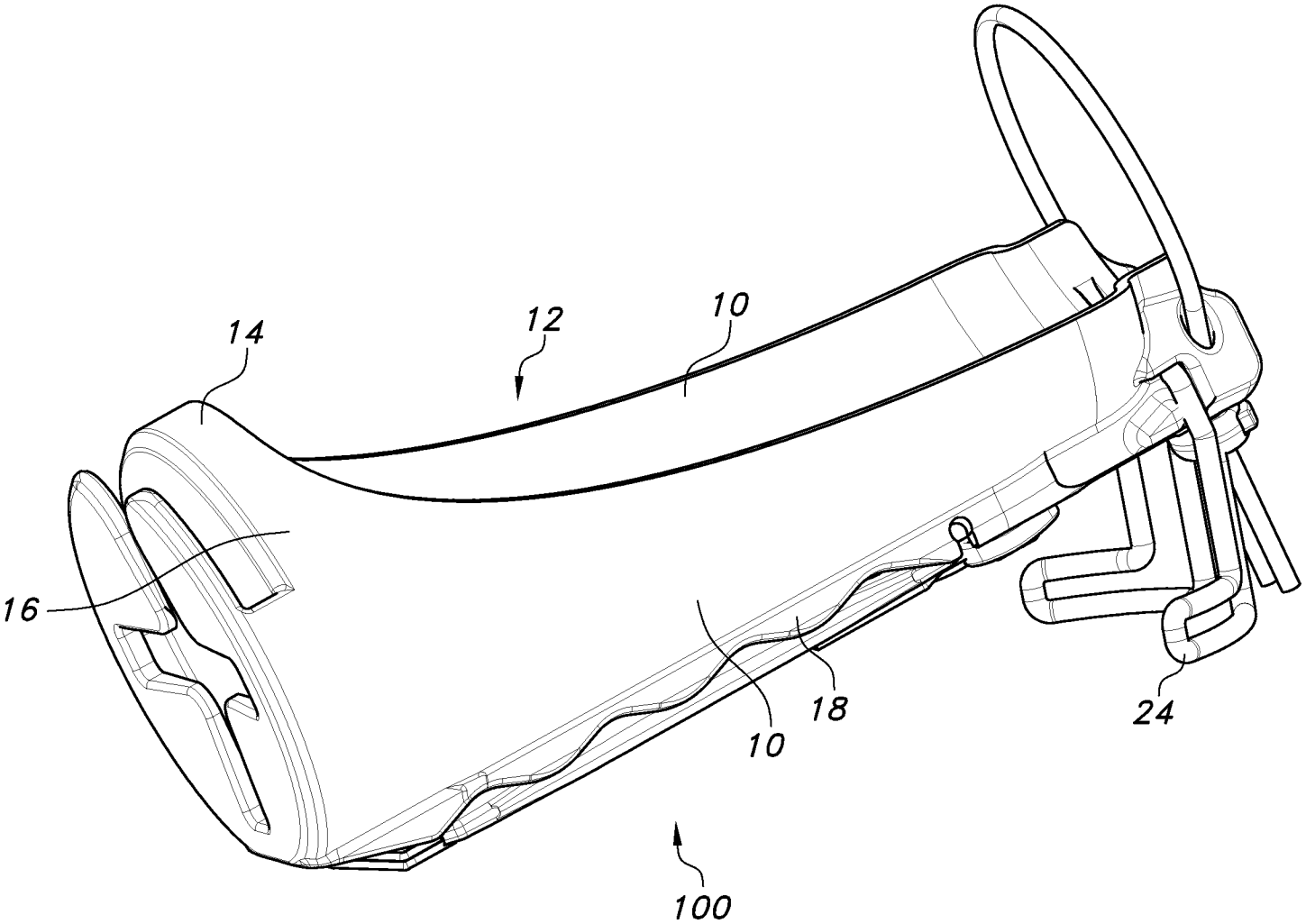
FIG. 8 is a perspective view of the device in a water-bowl configuration.

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

FIGS. 1-10 illustrate a container sleeve 100 according to the invention. The sleeve is primarily designed to function in two separate configurations. In a first configuration, the sleeve 100 is configured to hold a container B, such as a water bottle, however, in a second configuration it may also function as a bowl, such as a water bowl for dogs.

The sleeve has a main body 10 that is configured in shape and size to surround at least a portion of a body of the container B. In the embodiment shown in illustrations, the main body 10 is substantially cylindrical in shape and configured to fit around a conventional water bottle. The main body 10 generally has a closed sidewall with an open front area 12 where the container B may be inserted.

The main body 12 also has a backside 18 upon which a stand 24 is configured to attach. For example, in the embodiment shown, the stand 24 is attached to the backside 18 in a pivotable and collapsible manner such that it may be collapsed and stowed against the sleeve when not in use and extended into an approximately 90-degree angle relative to the backside when a user wishes to use it. The stand 24 may also be provided in other structural manners, for example it may be configured to be completely detachable. The stand may also be made as an integral part of the main body 18 rather than as a separate component.

Figure 9:
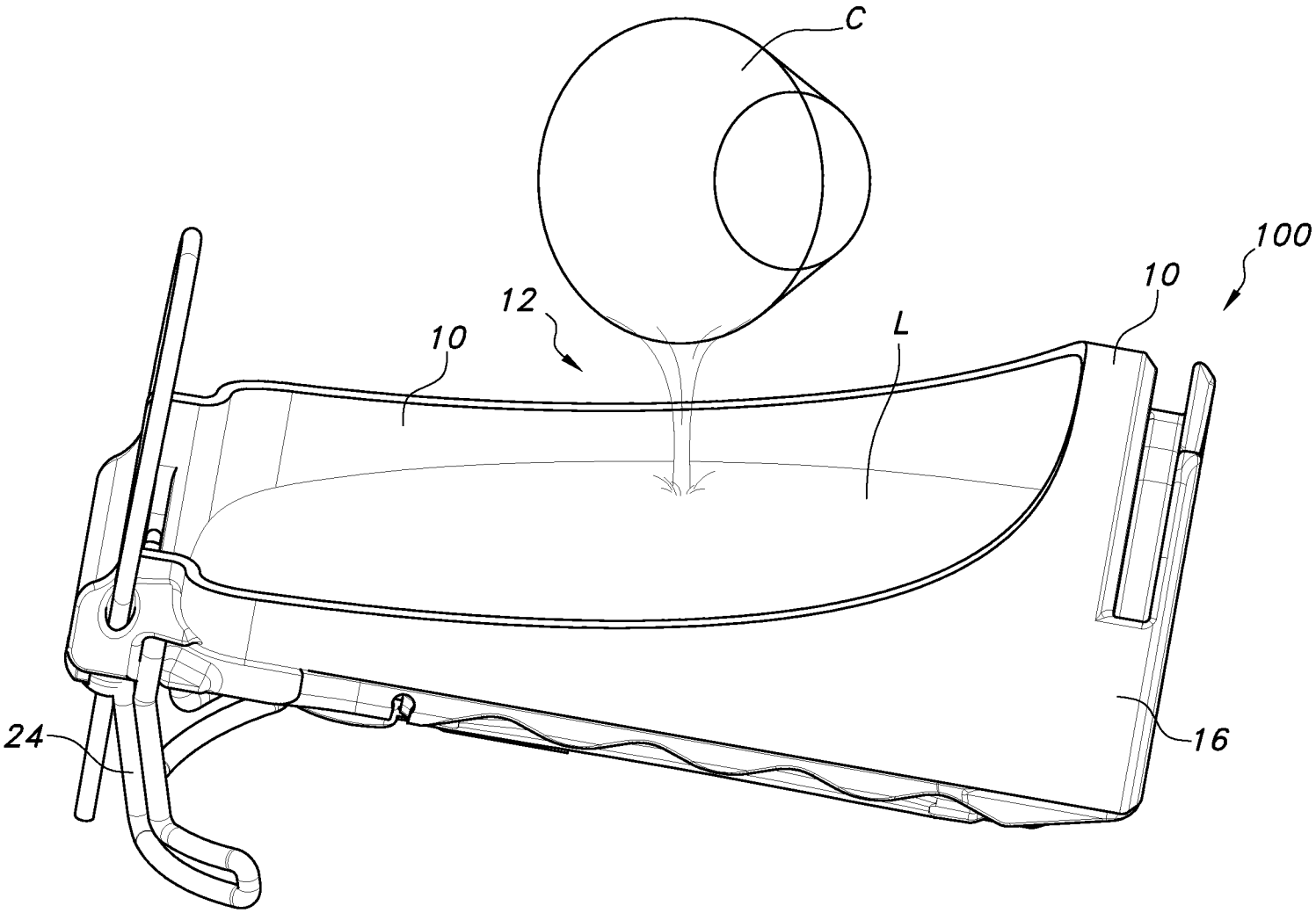
FIG. 9 is a perspective view of the device holding water.
Figure 10:
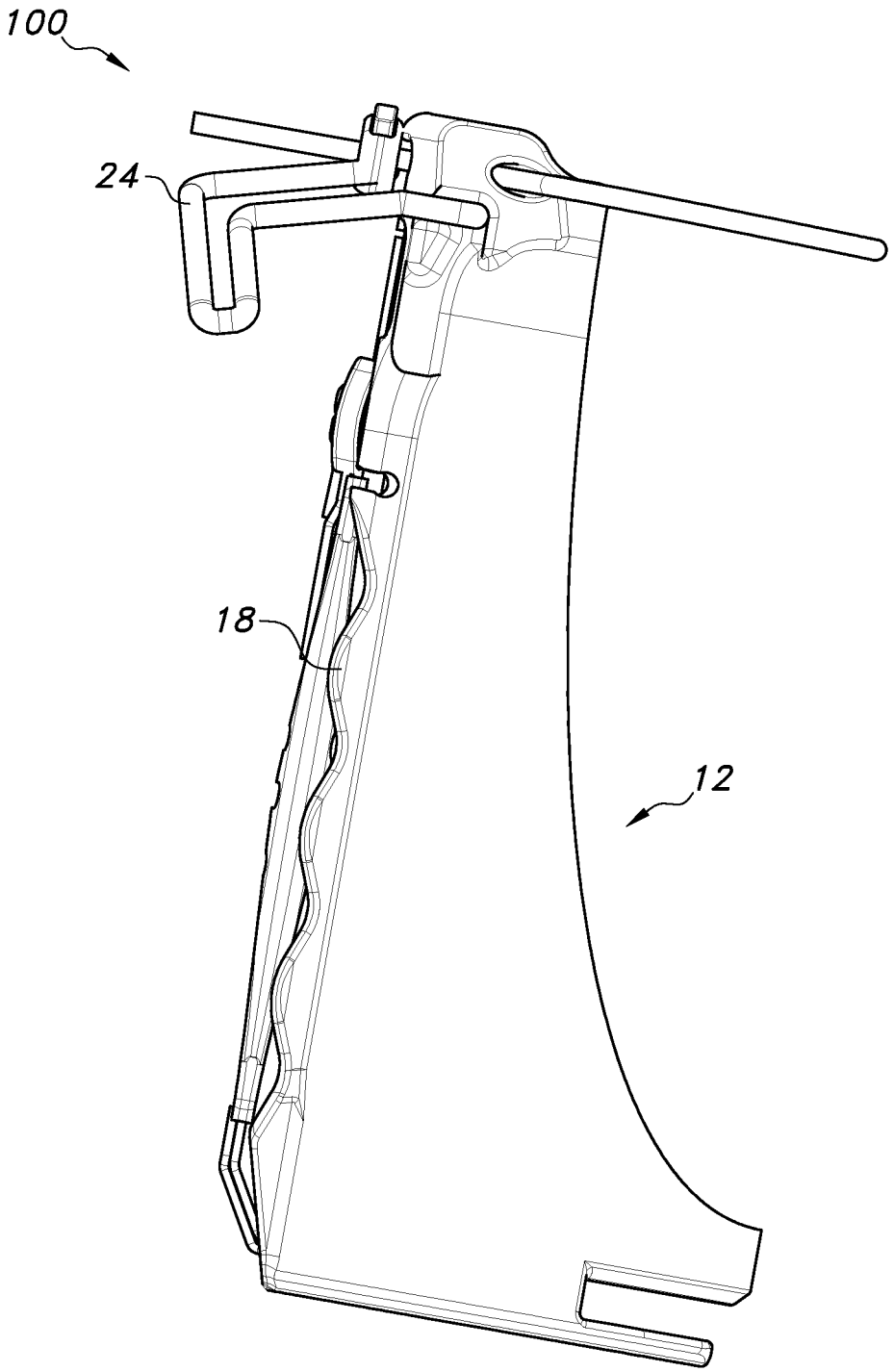
FIG. 10 is a perspective view of the support stand.

More specifically, the collapsible stand 24 is pivotably coupled to an upper portion of the main body 10 where it has a first end 27A and a second end 27B that are each inserted into openings 19A and 19B that are formed as an integral part of the main body 10. When in a collapsed position, the stand 24 fits tightly to the main body 10 so as not to be an obstruction. When the stand 24 is pivoted into its extended position, it supports the main body 10 when the sleeve 100 is placed on its side, with the upper end slightly elevated relative to the lower end. In this configuration, the sleeve acts as a bowl from which, for example, pets may drink. To illustrate this, FIG. 9 shows a cup C dispending a liquid L into the main body 10.

A bottom portion of the front area 12 has a lip 14, which extends upward from a bottom 16 of the sleeve, and that secures a lower portion of the container B in the sleeve 100.

The backside 18 of the main body 10 also includes an upper insertion slot 19A and a lower insertion slot 19B for securing a strap 22. In the embodiment shown the insertion slots 19A, 19B, are formed as an integral part of the main body 10. When the strap is attached to the bottle, it may assist the user in holding and carrying the bottle, particularly while hiking or running, where it lessens the burden on a user's grip strength. The strap may be comprised of many materials, such as canvas webbing or a rubber material such as polyurethane or polyvinyl chloride. The strap 22 may be configured to be adjustable in length using conventional means, and/or it may be made of an elastic material so as to have a measure of adjustability while maintaining a fixed or near-fixed length. In the case of an elastic strap, it may be attached to fit snuggly along the spine so that it does not interfere when the device 100 is in its bowl configuration and placed on a surface. Conventional securing means are provided on the upper and lower ends of the straps, such as securing tabs that may be inserted into the insertion slots.

A lower extended section 40 is attached to the main body 10 beneath the bottom 16. The lower section has a number of slits 42 that may be used to hold other items, such as doggy bags. For example, in the embodiment shown in FIG. 2, the slits are in the form of a cross or plus-sign, and in this form a pet waste bag may be tied in a knot and the knot inserted into open area between the bottom 16 and the lower section 40 where it is removably secured in the middle of the cross until the user has an opportunity to dispose of it.

An attachment mechanism 26 secures an upper end of the container B in the sleeve 100. The attachment mechanism 26 may be configured in a number of ways. In the embodiment shown in the drawings, two openings are provided in the upper end of the main body 10 through which a tie 28 or strap 28 is inserted and secured in a conventional manner, for example using cord lock or release toggle 32.

It is understood that the embodiments described herein are merely illustrative of the present invention. Variations in the construction of the sleeve may be contemplated by one skilled in the art without limiting the intended scope of the invention herein disclosed.

What is claimed is:

1. A sleeve for a container, the sleeve comprising:

a main body that is configured to fit around at least a portion of the container, the main body having a bottom area that is closed and a top area that is open, the main body further having a back and sidewalls that are liquid-tight and that form a semi-enclosed shape with a front side that is open;

a stand configured to couple to the main body, the stand configured to elevate an upper end of the main body when it is deployed and configured to fit against the main body when it is stowed;

the main body configured to alternatively secure the container or function as a bowl when the stand is deployed and the sleeve is positioned in an approximately horizontal orientation, the stand and main body configured to allow a liquid to be contained within the main body and be accessible to a user via the open front side.

2. The sleeve of claim 1, the stand coupled to the main body and configured to pivot between a position along a backside of the main body or to a deployed position that supports an upper end of the main body when the main body is in an approximately horizontal orientation.

3. The sleeve of claim 2, the main body further including a lip on a lower end of the front side.

4. The sleeve of claim 1, further including a strap coupled to a backside of the main body.

5. The sleeve of claim 4, wherein the strap is an elastic strap that fits closely to the backside.

6. The sleeve of claim 1, further including a lower section beneath the main body and that is connected to the main body, the lower section including one or more slits, the lower section having an open gap from the main body and having an opening between the main body and the lower section.

7. The sleeve of claim 6, the one or more slits forming an opening in the shape of a cross or plus sign.

8. The sleeve of claim 1, further including an attachment device that is configured to couple to an upper end of the main body to further secure the container in the main body.

* * * * *